United States Patent [19]

Kamo et al.

[11] 4,075,425

[45] Feb. 21, 1978

[54] MULTI-DIRECTIONAL SOUND SIGNAL REPRODUCING SYSTEM

[75] Inventors: Yoshihisa Kamo; Takeshi Tachibana; Masao Ichimura, all of Kawasaki, Japan

[73] Assignee: Nippon Columbia Kabushikikaisha, Tokyo, Japan

[21] Appl. No.: 614,873

[22] Filed: Sept. 19, 1975

[30] Foreign Application Priority Data

Sept. 24, 1974 Japan ..... 49-109715
Sept. 25, 1974 Japan ..... 49-115345[U]

[51] Int. Cl.[2] ..... H04R 5/00
[52] U.S. Cl. ..... 179/1 GQ; 170/100.4 ST
[58] Field of Search ..... 179/1 GQ, 15 BT, 100.4 ST, 179/100.1 TD

[56] References Cited

U.S. PATENT DOCUMENTS

| | | | |
|---|---|---|---|
| 3,761,628 | 9/1973 | Bauer | 179/1 GQ |
| 3,839,602 | 10/1974 | Takahashi et al. | 179/1 GQ |
| 3,843,850 | 10/1974 | Takahashi et al. | 179/1 GQ |
| 3,894,201 | 7/1975 | Pyles | 179/1 GQ |
| 3,934,087 | 1/1976 | Takahashi et al. | 179/15 BT |
| 3,936,618 | 2/1976 | Takahashi et al. | 179/1 GQ |
| 3,936,619 | 2/1976 | Sugimoto et al. | 179/1 GQ |

*Primary Examiner*—Douglas W. Olms

[57] ABSTRACT

The present invention is to increase the carrier level so as to improve the S/N ratio when the factor $T_\Sigma$, $T_T$ or $T_Q$ is small in level. When the level is low, noises are apt to be offensive to a listener's ear, but the reproducing level may be judged by the low level of $T_\Sigma$, $T_T$ or $T_Q$. Accordingly, the low level of $T_\Sigma$ or $T_T$ is detected to raise the carrier level, and to reduce an FM demodulation noise and hence to improve the total S/N ratio.

12 Claims, 14 Drawing Figures

Fig. 6A
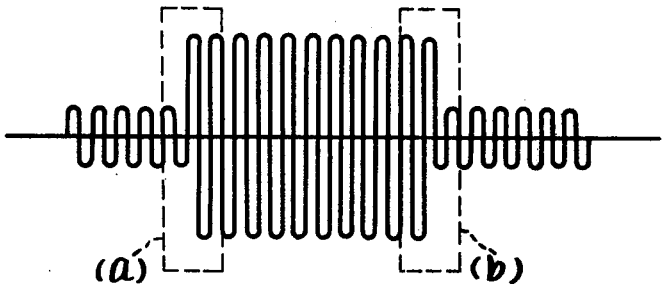
Fig. 6B
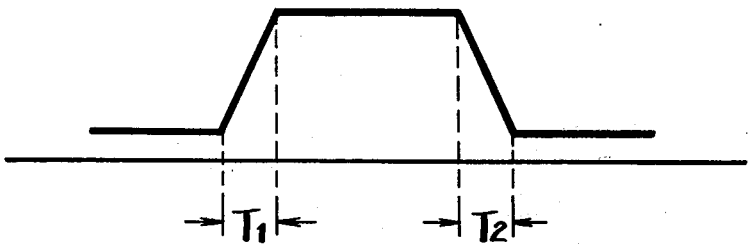
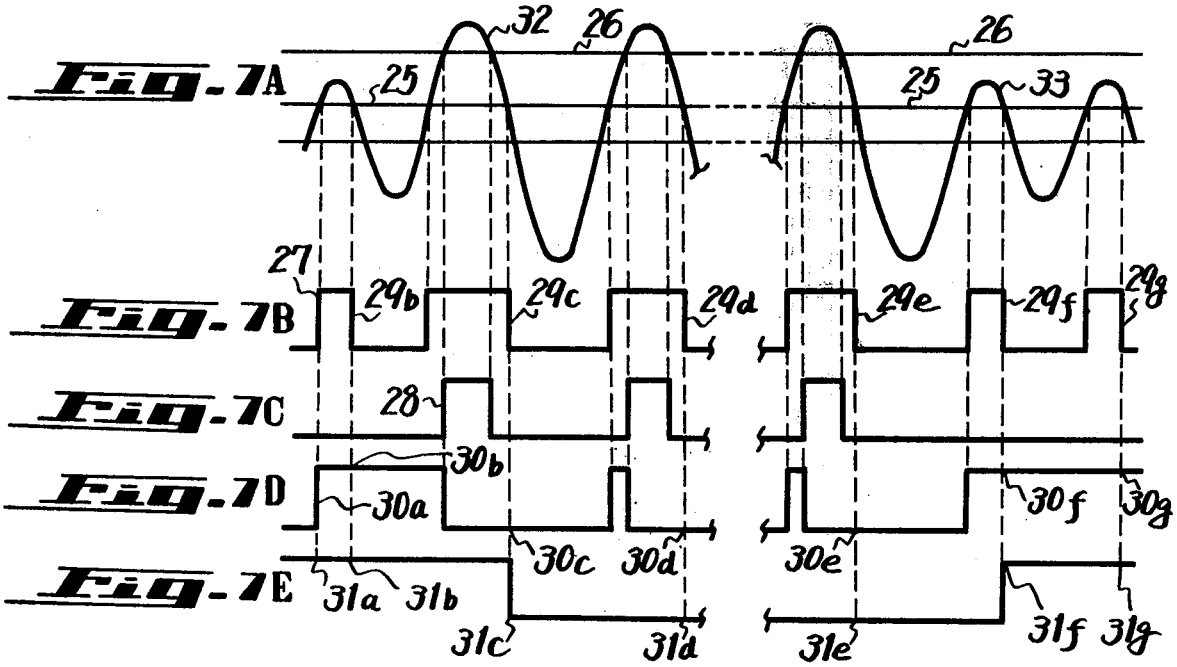

MULTI-DIRECTIONAL SOUND SIGNAL REPRODUCING SYSTEM

BACKGROUND OF THE INVENTION

1. Field of the Invention

The present invention relates to a multi-directional sound signal reproducing apparatus, and particularly to an apparatus for compensating for distortion or noise of a musical sound included in a disc which is engraved with a signal multiplied by a subchannel signal and a main signal.

2. Description of the Prior Art

There have been proposed several types of system as a multi-directional sound signal reproducing apparatus. In this connection, we have previously proposed the system using encoding signals in co-operation with Duan H. Cooper which system is publicly known. The above encoding signals will first be briefly described for easy understanding of the invention.

Now, a reference line O—O as shown in FIG. 1 is imaginatively set in a sound field and a sound source at a position having an angle $\theta'$ relative to the reference line O—O is taken as $S(\theta')$. If this localization accuracy is expressed as a function of azimuth $\theta'$, it is developed into Fourier series as follows:

$$S(\theta') = a_0 + a_1 \cos \theta' + a_2 \cos 2\theta' + \ldots + b_1 \sin \theta' + b_2 \sin 2\theta' + \ldots \quad (1)$$

If it is developed with the expression of exponential function using complex number, the following equation (2) is obtained:

$$S(\theta') = a_0 + c_1 e^{J\theta'} + c_2 e^{J2\theta'} + \ldots + c_{-1} e^{-J\theta'} + c_{-2} e^{-J2\theta'} + \ldots \quad (2)$$

The above mentioned localization accuracy of $S(\theta')$ can be expressed more precisely by increasing the number of terms in the above equation (2). However, the aforesaid encoding signal of the equation (2) is considered as an electric signal expressed by the following equation with respect to a phase angle $\theta$ whose value is the same as that of the azimuth $\theta'$.

$$S(\theta) = a_0 + c_1 e^{J\theta} + c_2 e^{J2\theta} + \ldots + c_{-1} e^{-J\theta} + c_{-2} e^{-J2\theta} + \ldots \quad (3)$$

In the equation (3), for signal transmission it is enough to transmit the number of coefficients corresponding to the channel number, and for n-channel transmission it is enough to transmit coefficients of the equation (3) including nth term at maximum. With respect to a plurality of sound sources $S_1$, $S_2$, $S_3 \ldots$, these coefficients of respective terms are respectively expressed as follows:

$$a_0 = T_\Sigma = S_1 + S_2 + S_3 + \ldots \quad (4a)$$

$$c_1 = T_\Delta = S_1 e^{-J\theta_1} + S_2 e^{-J\theta_2} + S_3 e^{-J\theta_3} + \ldots \quad (4b)$$

$$c_{-1} = T_T = S_1 e^{J\theta_1} + S_2 e^{J\theta_2} + S_3 e^{J\theta_3} + \ldots \quad (4c)$$

$$c_2 = T_Q = S_1 e^{-J2\theta_1} + S_2 e^{-J2\theta_2} + S_3 e^{-J2\theta_3} + \ldots \quad (4d)$$

$$c_{-2} = T_5 = S_1 e^{J2\theta_1} + S_2 e^{J2\theta_2} + S_3 e^{J2\theta_3} + \ldots \quad (4e)$$

By way of example, when 4-channel signals are transmitted, the signals expressed by coefficients $a_0$ to $c_2$ may be transmitted among those shown in the equations (4*a*), (4*b*) . . . The above-mentioned equation (4*a*) is called as $T_\Sigma$ which is a sum signal independent of phase, and the equation (4*b*) is called as $T_\Delta$ which corresponds to a difference signal of stereophonic signals.

Thus, in order to have compatibility with prior art stereophonic signals, the first- and second-channel signals are respectively taken as follows:

$$T_R = T_\Sigma + T_{66}, \; T_L = T_\Sigma - T_\Delta \quad (5)$$

If the equation (5) is substituted by the equations (4*a*) and (4*b*) and only one sound source $S_1$ is taken into consideration, the equation (5) is rewritten as follows:

$$T_R = \frac{S_1 + S_1 e^{-J\theta}}{K}, \; T_L = \frac{S_1 - S_1 e^{-J\theta}}{K}$$

If a condition $S_1 = 1$ is assumed, the following equations are obtained:

$$T_R = \frac{1 + e^{-J\theta}}{K} \quad (6a)$$

$$T_L = \frac{1 - e^{-J\theta}}{K} \quad (6b)$$

When these signals $T_R$ and $T_L$ are transmitted and 4-channel reproduction thereof is carried out at the reproduction side, it is called as BMX reproduction. In this case, the 4-channel reproduced sound field is stable, but the separation is poor.

Further, when the signal $T_T$ of the equation (4*c*) is transmitted together with the signals $T_R$ and $T_L$ and 4-channel reproduction thereof is carried out at the reproduction side, it is called as TMX reproduction. In this case, the separation is improved as compared with that of the BMX reproduction.

Furthermore, when the signal $T_Q$ of the equation (4*d*) is transmitted together with the signals $T_R$, $T_L$ and $T_T$ and 4-channel reproduction thereof is carried out at the reproduction side, it is called as QMX reproduction. In this case, we have ascertained that the separation is further improved as compared with the TMX reproduction.

SUMMARY OF THE INVENTION

In the present invention, when a signal $kT_T$ is added to the signals $T_R$ and $T_L$ of the BMX reproduction with a condition of $k<1$, it is defined as an intermediate reproducing condition between BMX and TMX. Similarly, when a signal $kT_Q$ is added to the signals $T_R$, $T_L$ and $T_T$ of the TMX reproduction with a condition of $k<1$, it is defined as an intermediate reproducing condition between TMX and QMX. Further, when a signal $k(T_T + T_Q)$ is added to the signals $T_R$ and $T_L$ with a condition of $k<1$, it is defined as an intermediate reproducing condition between BMX and QMX.

The present invention is devised in view of the fact that when the localized information signals or the signals $T_T$ and $T_Q$ are lowered in level to mix with the signals $T_\Sigma$ and $T_\Delta$ for providing 4-channel reproducing sound field, the separation is poor as compared with that of QMX reproduction but the localization at the center remains unchanged, and the reproduction of a musical sound can be much improved in a case of reproducing the 4-channel sound field having low noise and unchanged localization at the center with the levels of the signals $T_T$ and $T_Q$ being lowered as compared with a case where the sound field including noise is subjected to QMX reproduction at a time of low level reproduction. As one method thereof, the invention is to control the levels of the signals $T_T$ and $T_Q$ when the level of the signal $T_T$ is lowered to decrease noise for performing 4-channel reproduction.

According to the invention, there is provided a multi-directional sound signal reproducing apparatus characterized in that upon reproducing a carrier disc there are provided a level detecting means for detecting a signal having correlation with a demodulated signal of a sub-channel signal and a means for level-controlling the demodulated signal, whereby when a signal obtained by the level detecting means becomes lower than a predetermined level, the aforesaid demodulated signal is level-controlled to reduce a reproduction noise.

Accordingly, it is an object of this invention to provide a multi-directional sound signal reproducing apparatus in which noise is prevented from being increased at low level when a multi-directional sound signal is reproduced by using encoding signals, particularly when a carrier of 30 KHz is modulated by the signals $T_T$ and $T_Q$.

The other objects, features and advantages of the invention will be apparent from the following description taken in conjunction with the accompanying drawings.

DESCRIPTION OF THE PREFERRED EMBODIMENTS

A description will hereinafter be given on one embodiment of this invention with reference to FIGS. 2, 3 and 4.

Figure 1:
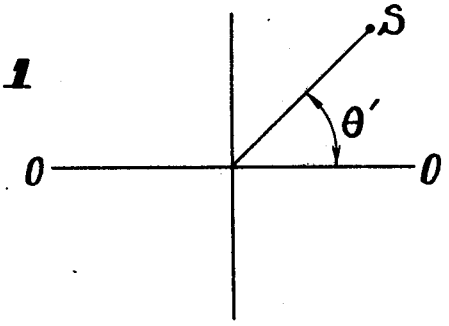
FIG. 1 is a view used for explaining this invention.
Figure 3A:
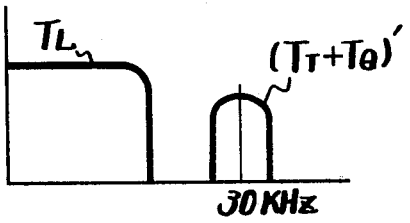
FIGS. 3A and 3B are graphs used for explaining the frequency band of signals upon recording a disc in this invention.
Figure 3B:
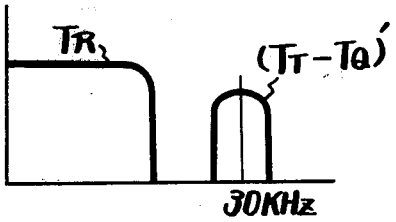
Figure 2:
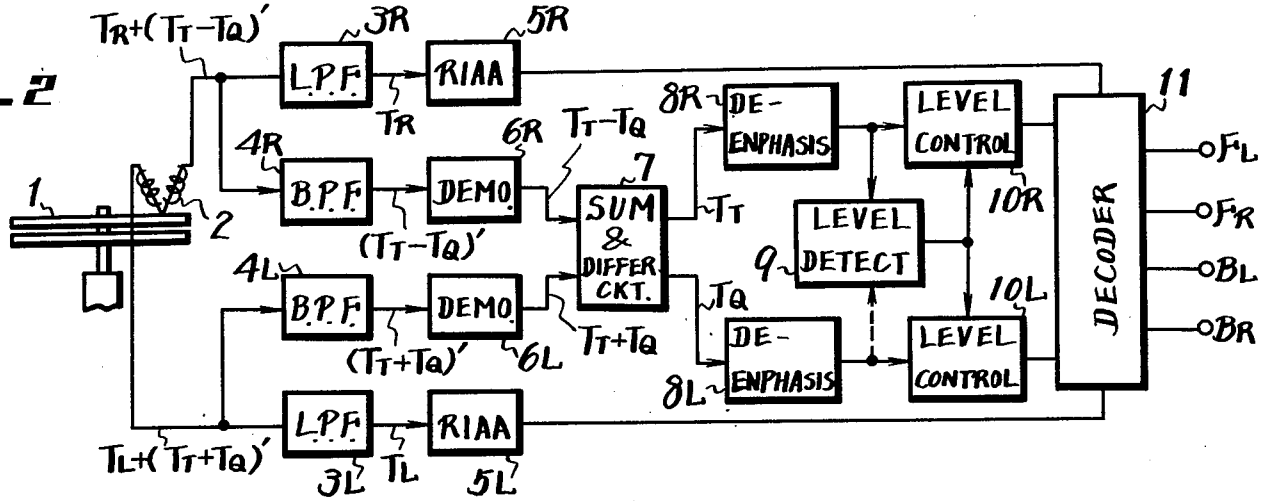
FIG. 2 is a block diagram showing an embodiment of a multi-directional sound signal reproducing apparatus according to this invention.

FIG. 2 is a block diagram showing one embodiment of the multi-directional sound signal reproducing apparatus according to this invention. In FIG. 2, reference numeral 1 designates a carrier disc and 2 a pickup device. A signal $T_L + (T_T + T_Q)'$ and a signal $T_R + (T_T - T_Q)'$, which are recorded on a sound groove of the carrier disc 1 with 45—45 system, are made multiplex as shown in FIGS. 3A and 3B. Two sets of multiplex signals reproduced from the pickup device 2, that is, the signals $T_R + (T_T - T_Q)'$ and $T_L + (T_T + T_Q)'$ are respectively divided into signals $T_R$ and $(T_T - T_Q)'$ by low- and band-pass filters 3R and 4R and into signals $T_L$ and $(T_T + T_Q)'$ by low- and band-pass filters 3L and 4L. These signals $T_R$ and $T_L$ are respectively fed through equalizers 5R and 5L each having RIAA characteristics to a decoder circuit 11. Meanwhile, the signals $(T_T - T_Q)'$ and $(T_T + T_Q)'$ are respectively fed to demodulators 6R and 6L to produce demodulated signals $T_T - T_Q$ and $T_T + T_Q$ respectively. The demodulated signals $T_T - T_Q$ and $T_T + T_Q$ are then fed to a sum and difference circuit 7 to derive therefrom output signals $T_T$ and $T_Q$ which are fed through de-emphasis circuits 8R and 8L to a decoder circuit 11. This decoder circuit 11 supplies four loud-speakers with signals of front-left FL, back-left BL, front-right FR and back-right BR, respectively, for being reproduced, thus a QMX reproducing apparatus being formed.

With the present invention, at the preceding stage of the decoder circuit 11 the signal $T_T$ is detected wheter it is low in level or not. To this end, as shown in FIG. 4, the signal $T_T$ is applied to a fullwave rectifier circuit **9*a* to produce a detected voltage which is applied to a level detecting circuit 9*b* such as a clipper with a predetermined threshold voltage to derive therefrom a pulsating voltage. This pulsating voltage is fed to a time constant circuit 9*c* to properly smooth its rising and falling portions and an output voltage therefrom is applied to level control circuits 10R and 10L** as a control voltage thereby to level-control the signals $T_T$ and $T_Q$.

With the above-mentioned arrangement, when a signal $T_T$ or $T_Q$ is low in level, the signal $T_Q$ or the signals $T_T$ and $T_Q$ are level-controlled, and if the signal $T_T$ is lowered in level upon QMX reproducing by way of example, the signal $T_Q$ is cut-off to provide the TMX reproduction or if the level of the signal $T_Q$ is lowered to be, for example, about ½ to ⅓ to provide the intermediate reproducing condition between TMX and QMX, it is possible to prevent the deterioration of S/N ratio caused by the level lowering of the modulated signal.

Figure 4:
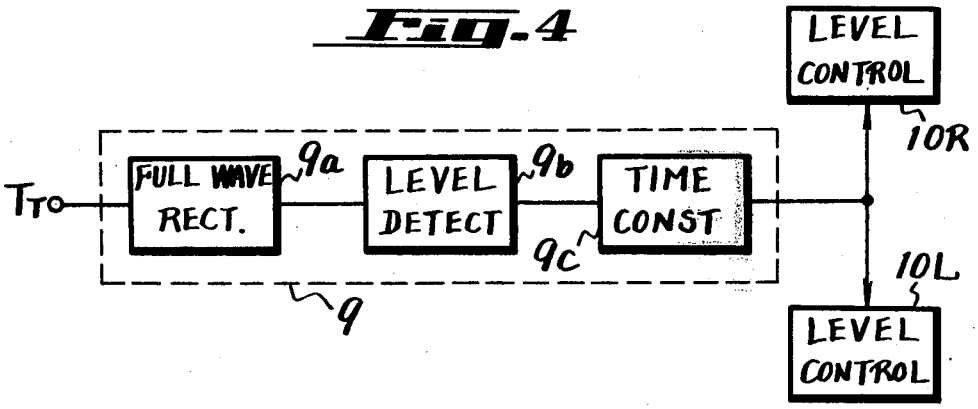
FIG. 4 is a block diagram showing a level control portion of this invention.

As the aforesaid level detecting circuit **9*b* in FIG. 4, there is well known a circuit consisting of a rectifier circuit and an integration circuit. However, this level detecting circuit is not applicable to this invention because of time lags and ripple components included in an output signal. Accordingly, an example of a level detecting circuit, which is free from the above described defects such as time lags, ripple components and the like and applicable to this invention with good results, will be hereinafter described with reference to FIG. 5**.

Figure 5:
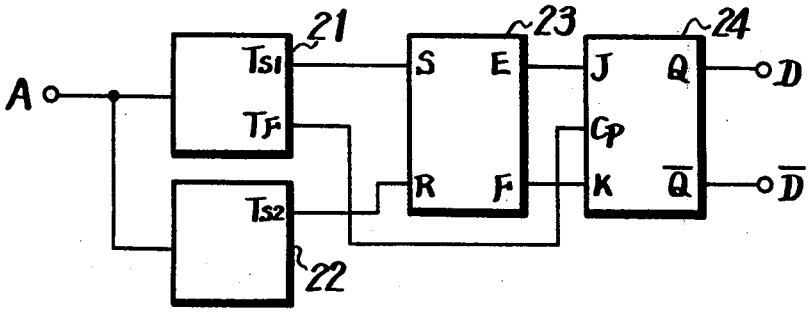
FIG. 5 is a block diagram showing an embodiment of the level detector used in the level control portion of FIG. 4, FIGS. 6A, 6B and FIGS. 7A to 7E, inclusive, are waveform diagrams used for explaining the operation of the level detector shown in FIG. 5.

In FIG. 5, an input terminal A is connected to input ends of first and second wave-shaping circuits 21 and 22, respectively. A first output terminal $TS_1$ of the first wave-shaping circuit 21 is connected to a set terminal S of an RS flip-flop circuit 23 and the second output terminal TF thereof is connected to a clock pulse terminal $C_p$ of a master-slave type JK flip-flop circuit 24. An output terminal $TS_2$ of the second wave-shaping circuit 22 is connected to a reset terminal R of the RS flip-flop circuit 23. Meanwhile, a first output terminal E of the RS flip-flop circuit 23 is connected to an input terminal J of the master-slave type JK flip-flop circuit 24 while a second output terminal F thereof is connected to an input terminal K of the master-slave type JK flip-flop circuit 24, output terminals Q and $\overline{Q}$ thereof being connected to output terminals D and $\overline{D}$, respectively.

An operation of the above mentioned circuit will next be described with reference to FIGS. 6A, 6B and FIGS. 7A to 7E, inclusive. At first, the input terminal A shown in FIG. 5 is applied with an alternating voltage shown in FIG. 6A. In this case, a waveform at a portion (*a*) encircled by dotted lines in FIG. 6A, that is, a portion where the amplitude of the alternating voltage increases is shown in FIG. 7A at its left side in an enlarged manner, and similarly a waveform at a portion (*b*) where the amplitude of the alternating voltage decreases is shown in FIG. 7A at its right side in an enlarged manner.

The first wave-shaping circuit 21 consists of a Schmidt circuit and a differentiation circuit (both not shown). Since the Schmidt circuit is selected to have an operating level shown in FIG. 7A by reference numeral 25, a waveform with its amplitude being sharply increased as shown in FIG. 7A at its left side is wave-shaped by the aforesaid level 25. Thus, a waveform shown in FIG. 7B is obtained as the output of this Schmidt circuit. Similarly, the second wave-shaping circit 22 consists of a Schmidt circuit and a differentiation circuit (both not shown). Since the Schmidt circuit therein is selected to have an operating level shown in FIG. 7A by reference numeral 26 which is higher than that shown by reference numeral 25, a waveform shown in FIG. 7C is obtained as the output of this Schmidt circuit.

Further, in the first wave-shaping circuit 21 the output from the Schmidt circuit is fed to the differentiation circuit to obtain at its first output terminal $TS_1$ a differential waveform of the rising-up portion 27 of the waveform shown in FIG. 7B. When this differentiated waveform is applied to the set terminal S of the RS flip-flop circuit 23, the first output terminal E of the RS flip-flop circuit 23 makes its logic level as "1". Similarly, in the second wave-shaping circuit 22 the output from the Schmidt circuit is fed to the differentiation circuit to obtain at its output terminal $TS_2$ a differentiated waveform of the rising-up portion 28 of the waveform shown in FIG. 7C. When this differentiated waveform is applied to the reset terminal R of the RS flip-flop circuit 23, the first output terminal E thereof makes its logic level as "0". From the second output terminal F of the RS flip-flop circuit 23 there is derived a waveform which is inverse to that of the first output terminal E.

The waveforms derived from the output terminal E and F of the RS flip-flop 23 are respectively fed to the input terminals J and K of the master-slave type JK flip-flop circuit 24. In the first wave-shaping circuit 21 the output from the Schmidt circuit is fed to the differentiation circuit to obtain at its second output terminal TF differentiated waveforms of falling-down portions 29b to 29g, inclusive, of the waveforms shown in FIG. 7B. When these differentiated waveforms are fed to the clock pulse terminal $C_p$ of the master-slave type JK flip-flop circuit 24, an output waveform as shown in FIG. 7E and an output waveform which is inverse to that shown in FIG. 7E are respectively obtained at the terminals Q and $\overline{Q}$ corresponding to the waveform form shown in FIG. 7D applied to the terminal J of the master-slave type JK flip-flop circuit 24 and the waveform, which is inverse to that shown in FIG. 7D, applied to its terminal K.

Assuming now that the terminals Q and $\overline{Q}$ of the master-slave type JK flip-flop circuit 24 are under a condition of "1, 0" as the left end of the waveform shown in FIG. 7E, the terminals Q and $\overline{Q}$ maintain the condition "1, 0" as shown by 31*a* in FIG. 7E at the rising-up portion 30*a* of the input waveform of the terminal J as shown in FIG. 7D. Next, when a clock pulse produced at the point 29*b* in FIG. 7B is applied to the clock pulse terminal $C_p$ of the master-slave type JK flip-flop circuit 24, the terminals J and K are "1, 0" as shown in FIG. 7D by 30*b*, so that the terminals Q and $\overline{Q}$ hold the condition "1, 0" as shown in FIG. 7E by 31*b*. When a clock pulse produced at the point 29*c* in FIG. 7B is fed to the clock pulse terminal $C_p$, the terminals J and K are "0, 1" as shown in FIG. 7D by 30*c*, so that the terminals Q and $\overline{Q}$ are inverted to "0, 1" as shown by FIG. 7E by 31*c*. When clock pulses produced at the points 29*d* to 29*e* in FIG. 7B are fed to the clock pulse terminal $C_p$, the terminals J and K are always "0, 1" as shown in FIG. 7D by 30*d* to 30*e*, so that the terminals Q and $\overline{Q}$ hold the condition "0, 1" as shown in FIG. 7E by 31*d* to 31*e*. Next, when a clock pulse generated at the point 29*f* in FIG. 7B is fed to the clock pulse terminal $C_p$, the terminals J and K are "1, 0" as shown in FIG. 7D by 30*f*, so that the terminals Q and $\overline{Q}$ are inverted to "1, 0" as shown in FIG. 7E by 31*f*. Further, when a clock pulse generated at the point 29*g* in FIG. 7B is fed to the clock pulse terminal $C_p$, the terminals J and K are "1, 0" as shown in FIG. 7D by 30*g*, so that the terminals Q and $\overline{Q}$ hold the condition "1, 0" as shown in FIG. 7E by 31*g*.

The above mentioned output waveform shown in FIG. 7E changes from high level to low level at the trailing end of an initial waveform 32 where the amplitude of the input signal shown in FIG. 7A starts to increase, that is, at the point 31*c* in FIG. 7E, and also changes from low level to high level at the trailing end of an initial waveform where the amplitude of the input signal starts to be restored, that is, at the point 31*f* in FIG. 7E. Accordingly, as compared with the prior art level detecting circuit which produces time lags shown by $T_1$ and $T_2$ in FIG. 6B due to the time constant of the circuit, the level detecting circuit used in this invention can greatly shorten its time lags because it produces the output waveform as shown in FIG. 7E.

Further, since the aforesaid output waveform shown in FIG. 7E is used only to detect whether the amplitude of the input signal shown in FIG. 6A or FIG. 7A is larger or smaller than the working level of the level detector, if a transistor or the like is previously set by a DC value corresponding to the working level 26 and this transistor or the like is switched by the logic level of the output waveform shown in FIG. 7E, a DC value corresponding to the amplitude of the input signal can be obtained at the output end of the transistor. Accordingly, when a plurality of level detectors as shown in FIG. 5, which are set at different working levels, are connected in parallel with one another as occasion demands, it will be apparent that DC levels corresponding to the levels of the input signal can be continuously obtained as the output. In the embodiment as mentioned above, only the positive level of its input alternating signal is taken into consideration. However, it will also be obvious that the same efect can be achieved even when a waveform of this input alternating signal passed through a rectifier circuit is applied to the input terminal A.

Figure 8:
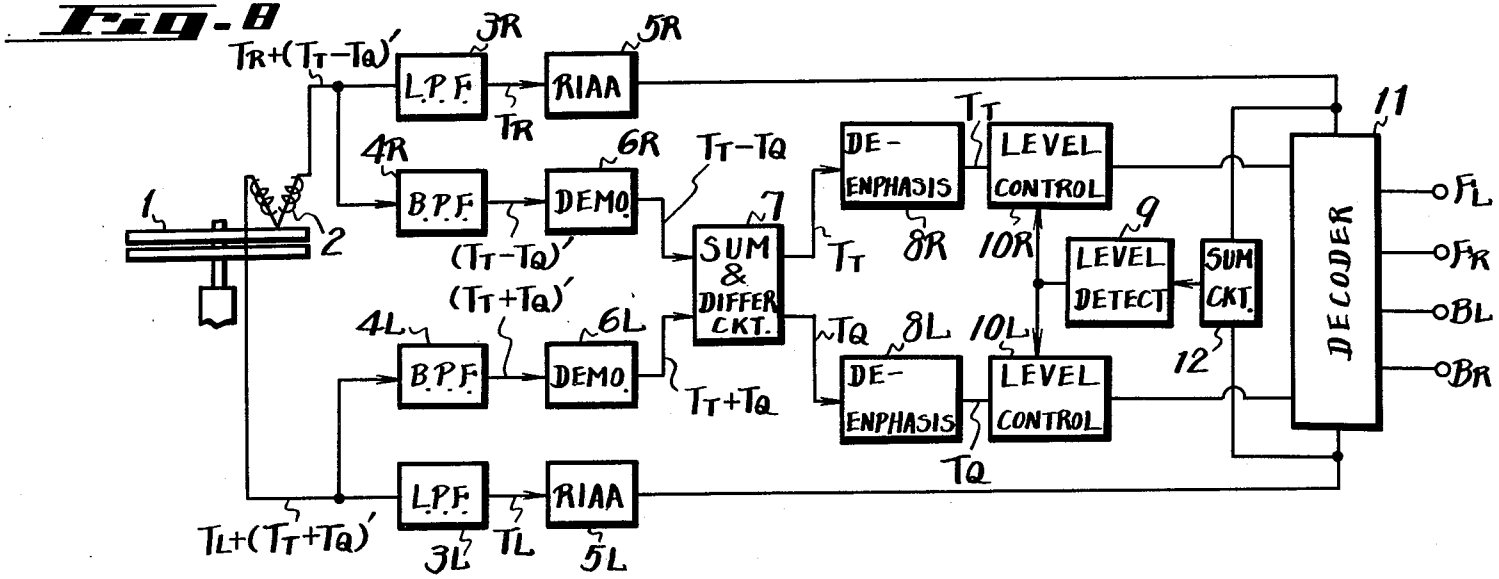
FIG. 8 is a block diagram showing another embodiment of the multi-directional sound signal reproducing apparatus according to this invention.

In the above described reproducing apparatus shown in FIG. 2, the levels of signals $T_T$ and $T_Q$ are controlled by the signal $T_T$ itself. Next, with reference to FIG. 8 a description will be given on another embodiment of the multi-directional sound signal reproducing apparatus of this invention in which the above levels are controlled by a signal $T_\Sigma$ having strong correlation with the signals $T_T$ and $T_Q$ and good reproduction characteristics. In FIG. 8, elements corresponding to those in FIG. 2 are shown by the same reference numerals with their description being omitted for the sake of brevity.

The signal $T_\Sigma$ has noise level which is not so much varied between the inner and outer peripheries of a recording disc as compared with those of the signals $T_T$ and $T_Q$ and its reproduction quality is good. In addition, the signal $T_\Sigma$ is suitable for judging low level of a musical sound. That is, the level of a musical sound is proportional to $T_\Sigma^2 + T_\Delta^2 + T_T^2 + T_Q^2$, and when a single source is used the levels of $T_\Sigma$, $T_\Delta$, $T_T$ and $T_Q$ are respectively the same, while when normal multi-sound sources are used the level of $T_\Sigma$ is mostly higher than those of $T_\Delta$, $T_T$ and $T_Q$. Therefore, the level of signal $T_\Sigma$ can be regarded as being almost proportional to the level of a musical sound.

In the example shown in FIG. 8, when the level judgement is actually carried out by the signal $T_\Sigma$, the main channel signals $T_R$ and $T_L$ are fed to a sum circuit 12 to derive therefrom the signal $T_\Sigma$ which is applied to the level detecting circuit 9 to derive therefrom a control voltage similarly as mentioned with reference to FIG. 4. Thus produced control voltage is applied to the level control circuits 10R and 10L to control the levels of the signals $T_T$ and $T_Q$.

Further, the signals $T_T$ and/or $T_Q$ included in a signal before being demodulated may be picked-up for detection.

As described above, the present invention has a great advantage such that the S/N ratio at low carrier level can be prevented from being deteriorated by the addition of the quite simple circuit.

It will be apparent that a number of changes and variations can be effected without departing from the scope of the novel concepts of the present invention.

We claim as our invention:

1. A multi-directional stereophonic sound reproducing apparatus for reproducing a multiplex signal of a plurality of stereophonic source signals, said multiplex signal including a first signal component $T_\Sigma$, a second signal component $T_\Delta$, a third signal component $T_T$ and a fourth signal component $T_Q$, wherein:

$T_\Sigma$ is the sum of the stereophonic source signal $t_\Delta$ is the difference of the stereophonic source signals $T_T$ is the first demodulated sub-channel information signal $T_Q$ is a second demodulated sub-channel information signal and, in which $(T_\Sigma + T_\Delta)$ is a first main signal $T_R$, $(T_\Sigma - T_\Delta)$ is a second main signal $T_L$, a carrier signal is angle-modulated with sub-signals $(T_T + T_Q)$, and said angle-modulated carrier signal is multi-imposed on said main signal, comprising:

(a) level detecting means comprising a circuit for slicing the $T_T$ signal at a first working level and for wave shaping said sliced signal, a circuit for slicing the $T_T$ signal at a second working level which is different from said first working level and for wave shaping said second sliced signal, and a circuit for transmitting waveforms at rising-up portions of said first and second wave shaped outputs to a flip-flop circuit and for applying outputs of said flip-flop circuit to a master-slave type JK flip-flop circuit at its terminals J and K, whereby a clock pulse produced at a falling-down portion of the waveform obtained by said circuit for wave shaping established to the first working level is applied to a clock terminal of said master-slave type JK flip-flop circuit so as to quickly respond to abrupt variation of the alternating input signal, and (b) level controlling means provided with an output signal of said level detecting means for controlling the level of said $T_T$ and $T_Q$ to reduce reproduction noise.

2. The multi-directional sound signal reproducing apparatus according to claim 1, in which said level controlling means controls the level of the demodulated signal $T_Q$ thereby changing a QMX reproducing condition including the main channel signals $T_L$, $T_R$ and the demodulated signals $T_T$, $T_Q$ to an intermediate reproducing condition between said QMX reproducing condition and a TMX reproducing condition including the main channel signals $T_L$, $T_R$ and the demodulated signal $T_T$.

3. The multi-directional sound signal reproducing apparatus according to claim 1, in which said level controlling means controls the level of the demodulated signal $T_T$ whereby changing a TMX reproducing condition including the main channel signals $T_L$, $T_R$ and the demodulated signal $T_T$ to an intermediate reproducing condition between said TMX reproducing condition and a BMX reproducing condition including the main channel signals $T_L$ and $T_R$ only.

4. The multi-directional sound signal reproducing apparatus according to claim 1, in which said level controlling means controls demodulated signals $T_T$ and $T_Q$ simultaneously thereby changing a QMX reproducing condition including the main channel signals $T_L$, $T_R$ and said demodulated signals $T_T$, $T_Q$ to an intermediate reproducing condition between said QMX reproducing condition and a BMX reproducing condition including said main channel signals $T_L$ and $T_R$ only.

5. A multi-directional stereophonic sound reproducing apparatus for reproducing a multiplex signal of a plurality of stereophonic source signals, said multiplex signal including a first signal component $T_\Sigma$, a second signal component $T_\Delta$, a third signal component $T_T$ and a fourth signal component $T_Q$, wherein:

$T_\Sigma$ is the sum of the stereophonic source signal $T_\Delta$ is the difference of the stereophonic source signals $T_T$ is a first demodulated sub-channel information signal $T_Q$ is a second demodulated sub-channel information signal and, in which $(T_\Sigma + T_{66})$ is a first main signal $T_R$, $(T_\Sigma - T_\Delta)$ is a second main signal $T_L$, a carrier signal is angle-modulated sith sub-signals $(T_T + T_Q)$, and said angle-modulated carrier signal is multi-imposed on said main signal, comprising:

(a) level detecting means comprising a circuit for slicing the $T_Q$ signal at a first working level and for wave shaping said sliced signal, a circuit for slicing the $T_Q$ signal at a second working level which is different from said first working level and for wave shaping said second sliced signal, and a circuit for transmitting waveforms at rising-up portions of said first and second wave shaped outputs to a flip-flop circuit and for applying outputs of said flip-flop circuit to a master-slave type JK flip-flop circuit at its terminals J and K, whereby a clock pulse produced at a falling-down portion of the waveform obtained by said circuit for wave shaping established to the first working level is applied to a clock terminal of said master-slave type JK flip-flop circuit so as to quickly respond to abrupt variation of the alternating input signal, and (b) level controlling means provided with an output signal of said level detecting means for controlling the level of said $T_T$ and $T_Q$ to reduce reproduction noise.

6. The multi-directional sound signal reproducing apparatus according to claim 5, in which said level controlling means controls the level of the demodulated signal $T_Q$ thereby changing a QMX reproducing condition including the main channel signals $T_L$, $T_R$ and the demodulated signals $T_T$, $T_Q$ to an intermediate reproducing condition between said QMX reproducing condition and a TMX reproducing condition including the main channel signals $T_L$, $T_R$ and the demodulated signal $T_T$.

7. The multi-directional sound signal reproducing apparatus according to claim 5, in which said level controlling means controls the level of the demodulated signal $T_T$ thereby changing a TMX reproducing condition including the main channel signals $T_L$, $T_R$ and the demodulated signal $T_T$ to an intermediate reproducing condition between said TMX reproducing condition and a BMX reproducing condition including the main channel signals $T_L$ and $T_R$ only.

8. The multi-directional sound signal reproducing apparatus according to claim 5, in which said level controlling means controls demodulated signals $T_T$ and $T_Q$ simultaneously thereby changing a QMX reproducing condition including the main channel signals $T_L$, $T_R$ and said demodulated signals $T_T$, $T_Q$ to an intermediate reproducing condition between said QMX reproducing condition and a BMX reproducing condition including said main channel signals $T_L$ and $T_R$ only.

9. A multi-directional stereophonic sound reproducing apparatus for reproducing a multiplex signal of a plurality of stereophonic source signals, said multiplex signal including a first signal component $T_\Sigma$, a second signal component $T_\Delta$, a third signal component $T_T$ and a fourth signal component $T_Q$, wherein:

$T_\Sigma$ is the sum of the stereophonic source signal $T_\Delta$ is the difference of the stereophonic source signals $T_T$ is a first demodulated sub-channel information signal $T_Q$ is a second demodulated sub-channel information signal and, in which $(T_\Sigma + T_\Delta)$ is a first main signal $T_R$, $T_\Sigma - T_\Delta)$ is a second main signal $T_L$, a carrier signal is angle-modulated with sub-signals $(T_T + T_Q)$, and said angle-modulated carrier signal is multi-imposed on said main signal, comprising:

(a) level detecting means comprising a circuit for clicing the $T_R + T_L$ signals at a first working level and for wave shaping said sliced signal, a circuit for slicing the $T_R + T_L$ signal at a second working level which is different from said first working level and for wave shaping said second sliced signal, and a circuit for transmitting waveforms at rising-up portions of said first and second wave shaped outputs to a flip-flop circuit and for applying outputs of said flip-flop circuit to a master-slave type JK flip-flop circuit at its terminals J and K, whereby a clock pulse produced at a falling-down portion of the wave form obtained by said circuit for wave shaping established to the first working level is applied to a clock terminal of said master-slave type JK flip-flop circuit so as to quickly respond to abrupt variation of the alternating input signal, and (b) level controlling means provided with an output signal of said level detecting means for controlling the level of said $T_T$ and $T_Q$ to reduce reproduction noise.

10. The multi-directional sound signal reproducing apparatus according to claim 9, in which said level controlling means controls the level of the demodulated signal $T_Q$ thereby changing a QMX reproducing condition including the main channel signals $T_L$, $T_R$ and the demodulated signals $T_T$, $T_Q$ to an intermediate reproducing condition between said QMX reproducing condition and a TMX reproducing condition including the main channel signals $T_L$, $T_R$ and the demodulated signal $T_T$.

11. The multi-directional sound signal reproducing apparatus according to claim 9, in which said level controlling means controls the level of the demodulated signal $T_T$ thereby changing the TMX reproducing condition including the main channel signals $T_L$, $T_R$ and the demodulated signal $T_T$ to an intermediate reproducing condition between said TMX reproducing condition and a BMX reproducing condition including the main channel signals $T_L$ and $T_R$ only.

12. The multi-directional sound signal reproducing apparatus according to claim 9, in which said level controlling means controls demodulated signals $T_T$ and $T_Q$ simultaneously thereby changing a QMX reproducing condition including the main channel signals $T_L$, $T_R$ and said demodulated signals $T_T$, $T_Q$ to an intermediate reproducing condition between said QMX reproducing condition and a BMX reproducing condition including said main channel signals $T_L$ and $T_R$ only.

* * * * *